US006193057B1

(12) United States Patent
Cappiello, Sr.

(10) Patent No.: US 6,193,057 B1
(45) Date of Patent: Feb. 27, 2001

(54) JEWELRY DISPLAY AND INFORMATION DEVICE

(75) Inventor: Frank J. Cappiello, Sr., Danbury, CT (US)

(73) Assignee: Frank J. Cappiello, Danbury, CT (US)

( * ) Notice: Subject to any disclaimer, the term of this patent is extended or adjusted under 35 U.S.C. 154(b) by 0 days.

(21) Appl. No.: 08/828,423

(22) Filed: Mar. 28, 1997

(51) Int. Cl.[7] ..... B65D 75/00
(52) U.S. Cl. ..... 206/6.1; 206/463
(58) Field of Search ..... 206/6.1, 461, 462, 206/463, 467, 470, 472; 383/38, 39

(56) References Cited

U.S. PATENT DOCUMENTS 2,676,699 * 4/1954 Friedman ..... 206/6.1
4,266,666 * 5/1981 Kuchenbecker ..... 206/467
4,466,534 * 8/1984 Dunn ..... 206/6.1
4,779,734 * 10/1988 Kydonieus ..... 206/467
5,209,344 * 5/1993 Smith ..... 383/39

FOREIGN PATENT DOCUMENTS

831550 * 3/1960 (GB) ..... 206/470

* cited by examiner

*Primary Examiner*—Jim Foster

(57) ABSTRACT

A jewelry display and information device is disclosed. The device includes an insert that may be folded about an item of jewelry to securely retain the item. The device further includes an outer surface for displaying information about the item of jewelry. After folding, the insert may be slid into a pocket in a transparent sheet for display of the item of jewelry and information about the item.

20 Claims, 2 Drawing Sheets

JEWELRY DISPLAY AND INFORMATION DEVICE

TECHNICAL FIELD

The present invention relates to jewelry, and more particularly to devices for displaying jewelry and information about the displayed jewelry.

BACKGROUND OF THE INVENTION

Typically the business of selling jewelry consists of displaying items of jewelry and gemstones either loosely or in a tray. This type of display requires frequent handling of the items in order to get information about the specific pieces of jewelry or the particular gems. Such frequent handling increases the risk of loss and is a very inefficient means to display such items to a potential customer.

The above art notwithstanding, people skilled in the art are working to develop devices for displaying jewelry and gemstones, and information about the displayed jewelry and gemstones, in a convenient and efficient manner.

DISCLOSURE OF THE INVENTION

According to the present invention, a jewelry display and information device includes a transparent sheet having a plurality of pockets and a plurality of inserts sized to be retained within the pockets. Each insert is formed from a thin layer folded to form two sections having an aperture, with a transparent membrane extending across the aperture. In the folded position an item of jewelry may be retained within the insert. The outer surface of the insert includes means to display descriptive information about the item of jewelry. In a particular embodiment, the inserts include means to removeably attach the sections of the insert together.

A principle advantage of the invention is that the device provides a convenient means to display jewelry items to a potential purchaser, while at the same time providing both the potential purchaser and the seller information about the displayed item without having to remove and handle the item. In addition, the means to removeably attach the section together secures the jewelry item into the insert to minimize the risk of loss during handling or re-arrangement of the inserts within the transparent sheet.

According to a particular embodiment of the present invention, the means to removeably attach the sections of the insert together includes resealable glue disposed along the outside edges of the insert. The glue permits the insert to be repeatedly opened for insertion and removal of an item of jewelry. In an alternate embodiment, the means to removeably attach the sections of the insert together includes strips of nylon fabric that fasten to themselves upon being pressed together, such as VELCRO.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
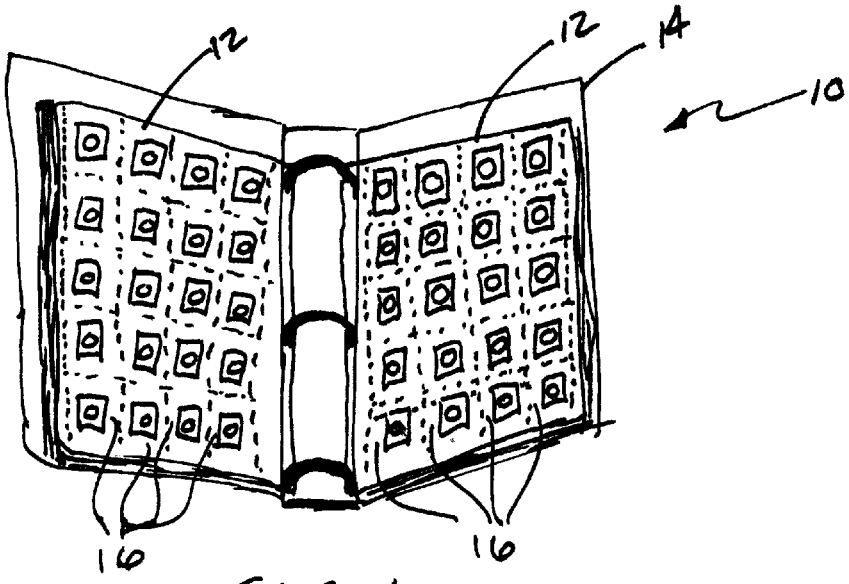
FIG. 1 is a perspective view of a jewelry display and information device according to the present invention.

Illustrated in FIG. 1 is a jewelry display and information device 10 according to the present invention. The device 10 is comprised of a plurality of transparent sheets 12 retained within a conventional loose-leaf notebook 14.

Each sheet 12 includes a plurality of pockets 16 spaced about the sheet and formed by bonding two layers of a transparent material, such as any of the numerous clear plastic materials, to form a cavity that is sealed on three sides 18 and open on the remaining side 20. As shown more clearly in FIG. 2, the upper side of the pockets is open, although the open side may be on any of the sides as desired.

Figure 2:
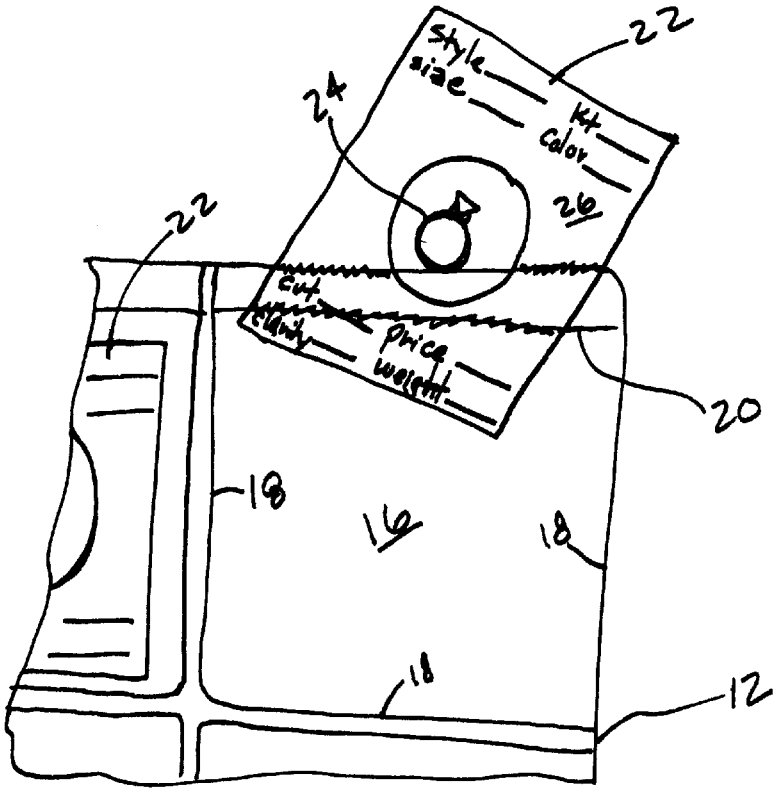
FIG. 2 is a view of a section of transparent sheet with an insert partially placed within a pocket in the sheet.

The device 10 includes a plurality of inserts 22, with each insert 22 sized to be securely placed within one of the pockets 16. As illustrated in FIG. 2, each insert 22 may be slid into and out of the pocket 16 through the open side 20. The insert 22 defines means to retain an item of jewelry 24 and means to display pertinent information about the item of jewelry 24 retained within the insert 22. The information is displayed on the outer surface 26 of the insert 22, and may include such standard information as style, material information, quality information, size and manufacturer's name. Since the sheets 12 are transparent, this information is readily viewed by a person examining the notebook 14. Having such information available facilitates the process of searching for a particular item or style of jewelry.

Figure 3:
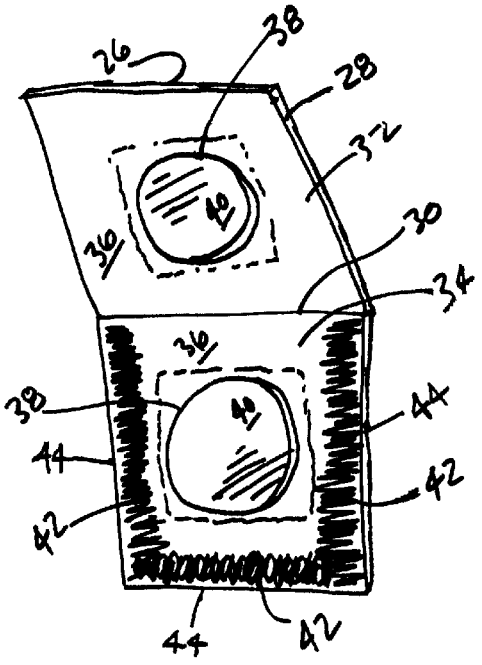
FIG. 3 is an unfolded insert.
Figure 4:
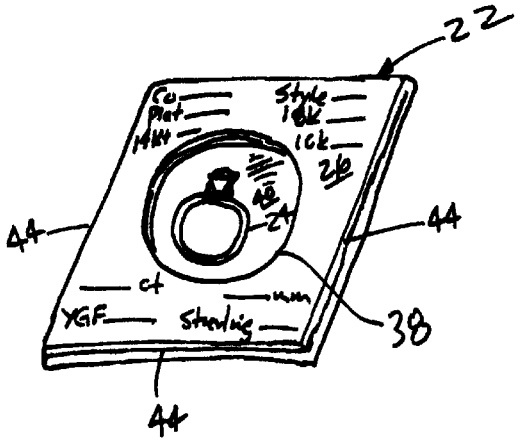
FIG. 4 is a closed insert with an item of jewelry retained within the insert.

Referring now to FIGS. 3 and 4, each insert 22 is formed from a thin layer 28 of stiff material, such as cardboard, that is folded along a centerline 30 to define two sections 32,34. Each section 32,34 has an inner surface 36 and the outer surface 26. The inner surfaces 36 are adjacent to each other when the insert 22 is in the folded position. The layer 28 includes a pair of apertures 38 that are located such that they are aligned after folding of the layer 28 along the centerline 30. A transparent membrane 40 extends across each aperture 38 and is sealed around the edges of each aperture 38. The apertures 38 and transparent membranes 40 form a viewing window for the item of jewelry retained within the insert 22.

Figure 5:
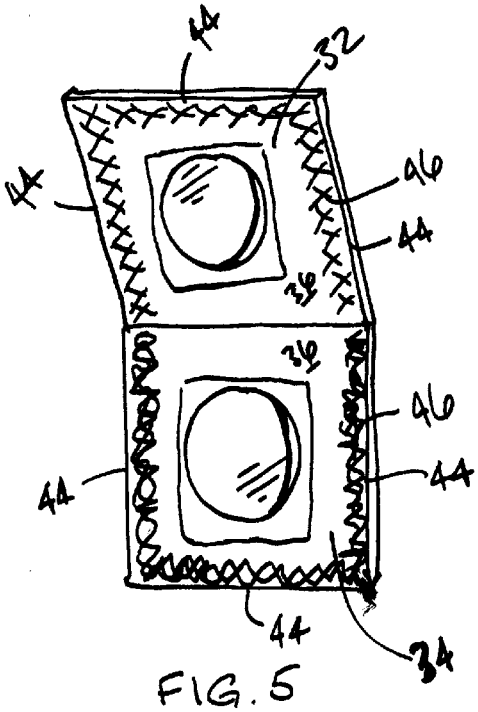
FIG. 5 is an alternate embodiment of an insert.

The inner surface 36 of one of the sections 34 includes resealable glue 42 that is disposed about the outside edges 44 of the section 34. The resealable glue 42 defines means to removeably attach the sections 32,34 of the insert 22 together. In an alternative embodiment shown in FIG. 5, the resealable glue may be replaced by strips 46 of nylon fabric that fasten to themselves upon being pressed together, such as material commonly known as VELCRO and commercially available. In this configuration, the strips 46 are disposed along the outside edges 44 of the inner surfaces 36 of both sections 32,34. Other means of removeably attaching the sections 32,34 together may be used, such as clips or snaps.

During use, an item of jewelry 24 is placed on one of the membranes 40 and the insert 22 is folded over and pressure is applied to the outside edges 44 to securely retain the item within the insert 22. Information about the specific item of jewelry 24 is placed on the outer surface 26 of the insert 22 in the spaces provided. The insert 22 may then be placed within one of the pockets 16 of one of the transparent sheets 12 for display. As a result, the item of jewelry 24 may be displayed such that it can be viewed quickly and pertinent information can be acquired without having to directly handle the item.

Although specific materials have been referred to in describing this embodiment of the invention, such as cardboard for the layer of the insert and plastic for the membranes and sheets, it should be understood that other materials may be used to perform the functions of the insert, membrane and sheet without departing from the spirit and scope of the invention.

Although the invention has been shown and described with respect with exemplary embodiments thereof, it should be understood by those skilled in the art that various changes, omissions, and additions may be made thereto, without departing from the spirit and scope of the invention.

What is claimed is:

1. A jewelry display and information device comprised of a transparent sheet having a plurality of pockets, a plurality of inserts, each insert sized to be retained within one of the pockets, wherein each insert is formed from a thin layer folded to form two sections, each section having an inner surface and an outer surface, with the inner surfaces being adjacent with the insert in the folded position, at least one of the sections having an aperture, each insert including a transparent membrane, the membrane extending across the aperture and secured to the section having the aperture, wherein in the folded position an item of jewelry, or component thereof, may be retained within the insert, wherein the outer surface of the section having the aperture includes means to display descriptive information about the item of jewelry, and wherein each of the plurality of inserts is retained within one of the plurality of pockets.

2. The jewelry display and information device according to claim 1, further including means to removeably attach the sections of the insert together, and wherein with the sections attached the insert defines means to secure an item of jewelry such that it is visible through the aperture.

3. The jewelry display and information device according to claim 2, wherein the means to removeably attach the sections of the insert together includes resealable glue disposed on at least one of the inner surfaces.

4. The jewelry display and information device according to claim 3, wherein the resealable glue extends along the outside edges of the inner surface.

5. The jewelry display and information device according to claim 2, wherein the means to removeably attach the sections of the insert together includes strips of nylon fabric that fasten to themselves upon being pressed together.

6. The jewelry display and information device according to claim 5, wherein the strips extend along the outside edges of the inner surface.

7. A jewelry display device comprised of a transparent sheet having a plurality of pockets, a plurality of inserts, each insert sized to be retained within one of the pockets, wherein each insert is formed from a thin layer folded to form two sections, each section having an inner surface and an outer surface, with the inner surfaces being adjacent with the insert in the folded position, at least one of the sections having an aperture, each insert including a transparent membrane and means to removeably attach the sections of the insert together into the folded position, the membrane extending across the aperture and secured to the section having the aperture, and wherein with the sections attached the insert defines means to secure an item of jewelry, or component thereof, such that it is visible through the aperture.

8. The jewelry display device according to claim 7, wherein the means to removeably attach the sections of the insert together includes resealable glue disposed on at least one of the inner surfaces.

9. The jewelry display device according to claim 8, wherein the resealable glue extends along the outside edges of the inner surface.

10. The jewelry display device according to claim 7, wherein the means to removeably attach the sections of the insert together includes strips of nylon fabric that fasten to themselves upon being pressed together.

11. The jewelry display and information device according to claim 10, wherein the strips extend along the outside edges of the inner surface.

12. An insert for use in a jewelry display and information device, the jewelry display and information device comprised of a transparent sheet having a plurality of pockets, the insert sized to be retained within one of the pockets, wherein the insert is formed from a thin layer folded to form two sections, each section having an inner surface and an outer surface, with the inner surfaces being adjacent with the insert in the folded position, at least one of the sections having an aperture, the insert including a transparent membrane, the membrane extending across the aperture and secured to the section having the aperture, wherein in the folded position an item of jewelry, or component thereof, may be retained within the insert, and wherein the outer surface of the section having the aperture includes means to display descriptive information about the item of jewelry, and further including means to removeably attach the sections of the insert together in a manner permitting the sections to be resealably engaged, wherein with the sections attached the insert defines means to secure an item of jewelry such that it is visible through the aperture.

13. The insert according to claim 12, wherein the means to removeably attach the sections of the insert together includes resealable glue disposed on at least one of the inner surfaces.

14. The insert according to claim 13, wherein the resealable glue extends along the outside edges of the inner surface.

15. The insert according to claim 12, wherein the means to removeably attach the sections of the insert together includes strips of nylon fabric that fasten to themselves upon being pressed together.

16. The insert according to claim 15, wherein the strips extend along the outside edges of the inner surface.

17. An insert for use in a jewelry display device, the jewelry display device comprised of a transparent sheet having a plurality of pockets, the insert sized to be retained within one of the pockets, wherein the insert is formed from a thin layer folded to form two sections, each section having an inner surface and an outer surface, with the inner surfaces being adjacent with the insert in the folded position, at least one of the sections having an aperture, the insert including a transparent membrane and means to removeably attach the sections of the insert together into the folded position in a manner permitting the sections to be resealably engaged, the membrane extending across the aperture and secured to the section having the aperture, and wherein with the sections attached the insert defines means to secure an item of jewelry, or component thereof, such that it is visible through the aperture.

18. The insert according to claim 17, wherein the means to removeably attach the sections of the insert together includes resealable glue disposed on at least one of the inner surfaces.

19. The insert according to claim 17, wherein the means to removeably attach the sections of the insert together includes strips of nylon fabric that fasten to themselves upon being pressed together.

20. A jewelry display and information device comprised of a sheet having a plurality of pockets, wherein each pocket is formed at least in part from a transparent material, a plurality of inserts, each insert sized to be retained within one of the pockets, wherein each insert is formed from a thin layer folded to form two sections, each section having an inner surface and an outer surface, with the inner surfaces being adjacent with the insert in the folded position, at least one of the sections having an aperture, each insert including a transparent membrane, the membrane extending across the aperture and secured to the section having the aperture, wherein in the folded position an item of jewelry, or component thereof, may be retained within the insert, wherein the outer surface of the section having the aperture includes means to display descriptive information about the item of jewelry, and wherein each of the plurality of inserts is retained within one of the plurality of pockets.

* * * * *